US007556524B2

(12) United States Patent
Kuo et al.

(10) Patent No.: US 7,556,524 B2
(45) Date of Patent: Jul. 7, 2009

(54) EASY-PULL TYPE SWIVEL PLUG

(75) Inventors: Ming-Chou Kuo, Taipei (TW); Mei-Ju Lin, Tucheng (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 11/979,375

(22) Filed: Nov. 2, 2007

(65) Prior Publication Data

US 2009/0117776 A1 May 7, 2009

(30) Foreign Application Priority Data

Sep. 29, 2007 (TW) ..... 96136514 A

(51) Int. Cl.
*H01R 13/00* (2006.01)

(52) U.S. Cl. ..... 439/484

(58) Field of Classification Search ..... 439/484, 439/483

See application file for complete search history.

(56) References Cited

U.S. PATENT DOCUMENTS 2,507,092 A * 5/1950 Cline ..... 439/484
5,148,348 A * 9/1992 White ..... 361/658
5,775,921 A * 7/1998 Chou ..... 439/21

* cited by examiner

*Primary Examiner*—Phuong K Dinh
(74) *Attorney, Agent, or Firm*—Rosenberg, Klein & Lee

(57) ABSTRACT

An easy-pull type swivel plug includes a body, a rotatable disk and a handle. The rotatable disk is rotatably provided on one side of the body. The rotatable disk is provided with two conductive pieces. The two conductive pieces extend beyond the body. The handle is pivoted to the other side of the body opposite to the rotatable disk in a liftable and foldable manner. The pivoting position between the handle and body corresponds to the center of the rotatable disk. Via this arrangement, the deformation of the conductive pieces caused by a torque generated in misalignment with the center can be avoided and the user can unplug more easily with less labor.

7 Claims, 2 Drawing Sheets

EASY-PULL TYPE SWIVEL PLUG

BACKGROUND OF THE INVENTION

1. Field of the Invention

The present invention relates to an easy-pull type swivel plug, and in particular to an easy-pull type swivel plug that supplies the electricity to electrical appliances and can be unplugged easily.

2. Description of Related Art

A plug is a necessary component for supplying the electricity to electrical appliances. The power of various electrical appliances is delivered from the plug and a power supply line. Therefore, the manufacturer and researcher pay more and more attention to the improvement of the plug.

As for conventional plugs, Taiwan Patent Publication No. M277125 published on 1 Oct. 2005 discloses a plug having a pull ring, which includes a hollow casing, at least two conductive pieces, a lead, a pull ring and two pivoting pieces. The casing has two connecting portions opposite to each other. The two conductive pieces are disposed in the casing. The lead is disposed in the casing and connected to the conductive pieces. The pull ring has a U shape and both ends thereof have a pivoting hole respectively. The pull ring straddles on the casing, so that the two pivoting holes correspond to the two connecting portions. The two pivoting pieces penetrate movably through the two pivoting holes of the pull ring with one end thereof being combined with one connecting portion of the casing. The other end of each pivoting piece has a stopping portion. The diameter of the stopping portion is larger than that of the pivoting hole.

However, the pull ring of the above-mentioned conventional plug has a U shape with both ends thereof being combined on two opposing lateral surfaces of the casing. Therefore, when a user pulls the pull ring to unplug, the tension force exerted by the user may be distributed on both lateral surfaces of the casing without concentrating, and thus the plug cannot be unplugged easily.

Further, the number of the components used between the casing and the pull ring is so many that it is inconvenient to assemble them together, increasing the production cost.

Therefore, in view of the above the drawbacks, the inventor proposes the present invention to overcome the above problems based on his deliberate research.

SUMMARY OF THE INVENTION

The primary object of the present invention is to provide an easy-pull type swivel plug, whereby the user can unplug it with less labor and the deformation of the conductive pieces can be avoided.

In order to achieve the above object, the present invention provides an easy-pull type swivel plug, which includes a body; a rotatable disk rotatably provided on one side of the body, the rotatable disk being provided with at least two conductive pieces, the two conductive pieces extending beyond the body; and a handle pivoted to the other side of the body opposite to the rotatable disk in a liftable and foldable manner, the pivoting position between the handle and body corresponding to the center of the rotatable disk.

The present invention has the following effect. The rotatable disk of the present invention can drive the two conductive pieces to rotate in the range of 360 degrees. The degree of rotation can be adjusted according to different conditions and orientations, thereby making the usage of the plug more flexible. Further, the pivoting position between the handle and body corresponds to the center of the rotatable disk. In this way, the deformation of the conductive pieces caused by a torque generated in misalignment with the center can be avoided and the user can unplug more easily with less labor.

In order to further understand the technique, method and effects employed in the present invention to achieve the desired objects, a detailed description relating thereto will be made with reference to the accompanying drawings, thereby verifying the objects, characteristics and features of the present invention. However, it should be understood that the drawings are illustrative only but not used to limit the present invention.

DETAILED DESCRIPTION OF THE PREFERRED EMBODIMENTS

Figure 1:
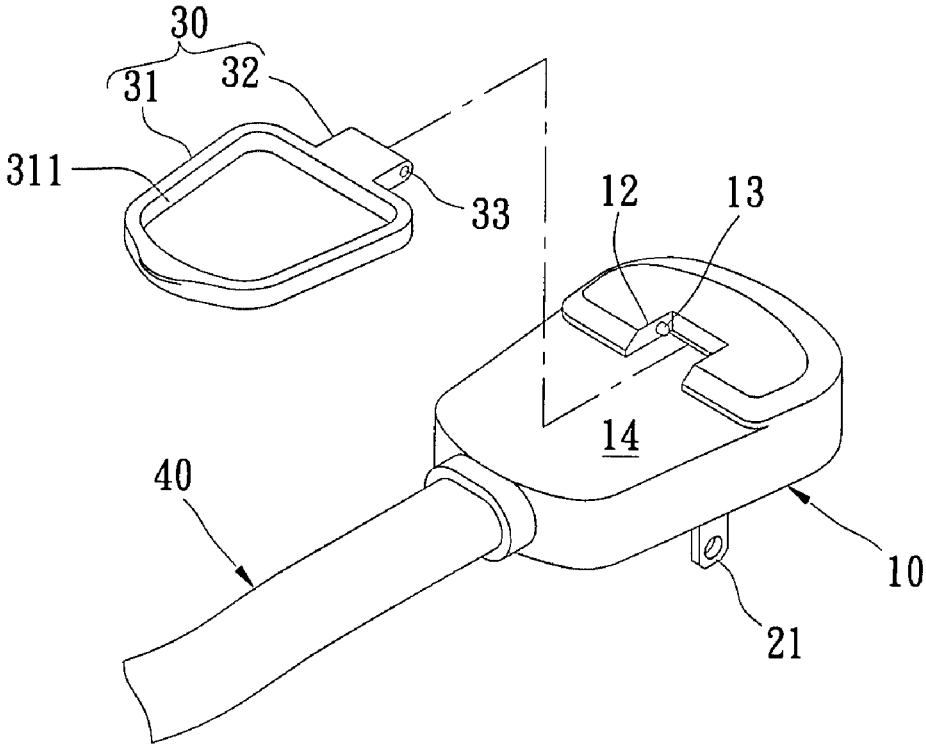
FIG. 1 is an exploded perspective view of the present invention.
Figure 2:
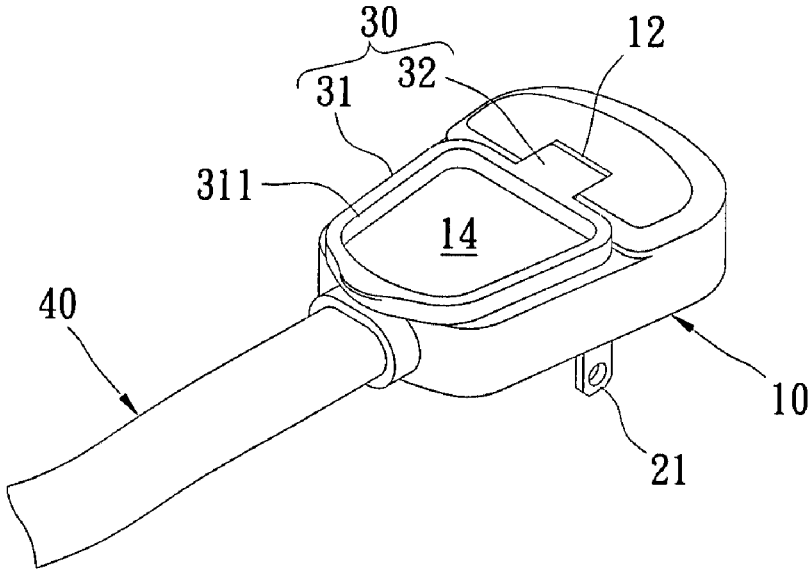
FIG. 2 is an assembled perspective view of the present invention.
Figure 3:
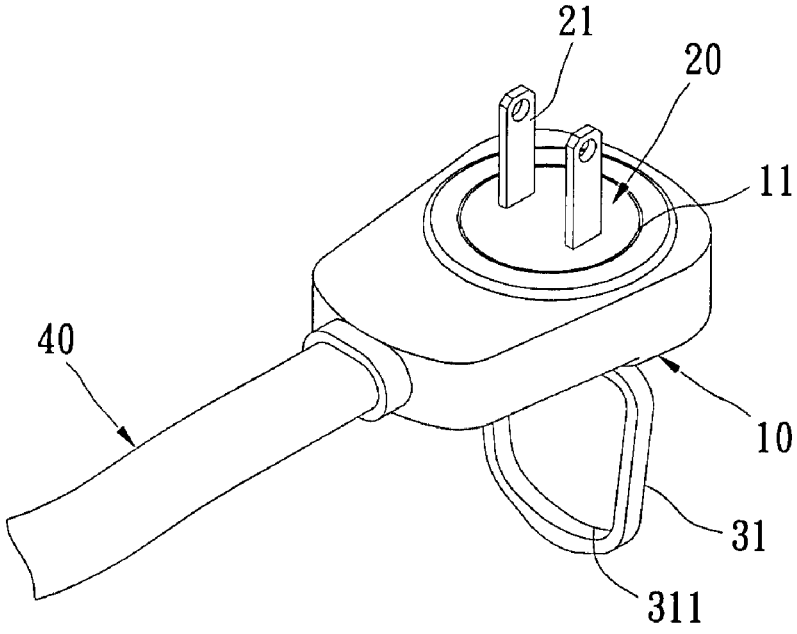
FIG. 3 is an assembled perspective view of the present invention from another viewing angle.

Please refer to FIGS. 1 to 3. The present invention provides an easy-pull type swivel plug that can be inserted into a socket (not shown) of utility power supply. The easy-pull type swivel plug includes a body 10, a rotatable disk 20, a handle 30 and a power supply line 40. The body 10 is made of insulating materials and is flat. One side of the body 10 is provided with a circular accommodating trough 11 (FIG. 3) for accommodating the rotatable disk 20.

The rotating disk 20 is made of insulating materials and has a circular shape (FIG. 3). The rotatable disk 20 is rotatably provided in the accommodating trough 11 on one side of the body 10, so that the rotatable disk 20 can rotate in the range of 360 degrees with respect to the body 10. The connecting structure of the rotatable disk 20 and the body 10 is familiar to those skilled in the art, and the present invention does not intend to limit the connecting structure to the illustrative form. Thus, the description thereof is omitted.

In the present embodiment, the rotatable disk 20 is fixedly provided with two conductive pieces 21. However, the number of the conductive pieces 21 is not limited thereto and can be three or other suitable number. The two conductive pieces 21 are made of conductive metal and extend beyond the body 10.

The front half portion of the other side of the body 10 opposite to the rotatable disk 20 has a first connecting portion 12. In the present embodiment, the first connecting portion 12 is a trough, but not limited thereto. The position of the first connecting portion 12 corresponds to the center of the rotatable disk 20. Further, the two opposing inner walls of the first connecting portion 12 (i.e. trough) are provided with a first pivoting portion 13 respectively (FIG. 1). In the present embodiment, the first pivoting portion 13 is a pivoting shaft.

The rear half portion of the other side of the body 10 opposite to the rotatable disk 20 is provided with an accommodating space 14 for accommodating the handle 30.

The handle 30 comprises a ring portion 31 and a second connecting portion 32. The ring portion 31 is provided with a penetrating hole 311 for allowing a finger to be disposed therein. In the present embodiment, the second connecting portion 32 is a protruding block that is formed by protruding forwardly from the front side of the ring portion 31, but it is not limited thereto. The two opposing side walls of the second connecting portion 32 are provided with two second pivoting portions 33 to correspond to the two first pivoting portions 13 of the first connecting portion 12 (FIG. 1). In the present embodiment, the second pivoting portion 33 is a pivoting hole.

Alternatively, the first pivoting portion 13 can be a pivoting hole, and the second pivoting portion 33 is a pivoting shaft (not shown). Via this arrangement, the pivoting effect can be also achieved.

The power supply line 40 is connected to the rear end of the body 10. One end of the power supply line 40 penetrates into the body 10 and is connected electrically to the two conductive pieces 21.

In assembly, the second connecting portion 32 (i.e. the protruding block) of the handle 30 is accommodated in the first connecting portion 12 (i.e. the trough) of the body 10. Further, the two first pivoting portions 13 (i.e. the pivoting shafts) of the first connecting portion 12 are inserted into the two second pivoting portions 33 (i.e. the pivoting holes) of the second connecting portion 32, so that the second connecting portion 32 can be pivoted to the first connecting portion 12. In this way, the handle 30 can be pivoted to the other side of the body 10 opposite to the rotatable disk 20 in a liftable and foldable manner. Also, the pivoting position between the handle 30 and the body 10 corresponds to the center of the rotatable disk 20. Via the above constitution, the easy-pull type swivel plug of the present invention can be obtained.

Figure 4:
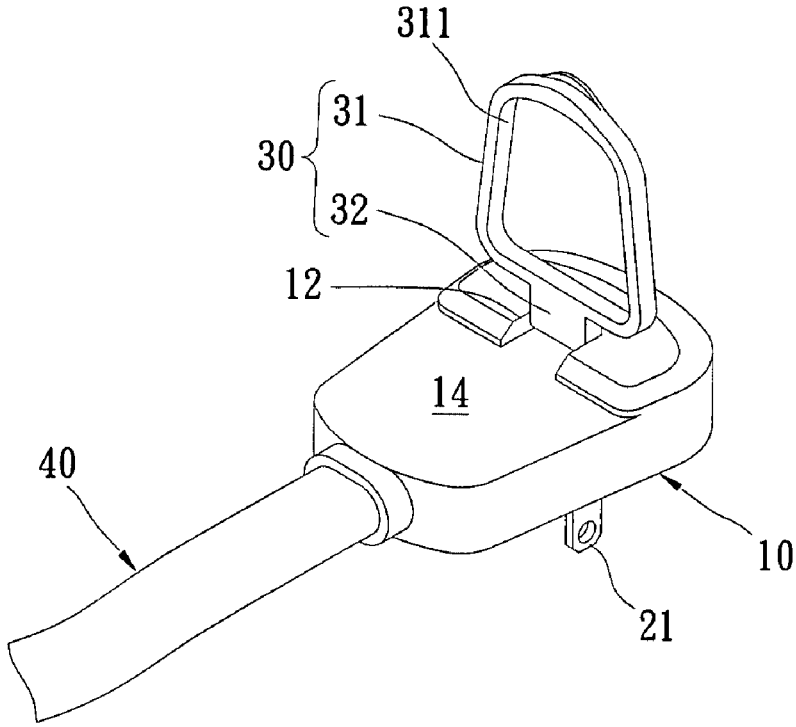
FIG. 4 is a perspective view showing the handle of the present invention being lifted.

Please refer to FIG. 4. Since the handle 30 of the present invention can be rotatably pivoted to the body 10, the handle 30 can rotate 90 degrees when the handle 30 is lifted, thereby obtaining an orientation perpendicular to the body 10.

When the easy-pull type swivel plug of the present invention is to be unplugged, the user only needs to lift the handle 30 and then put his/her finger into the penetrating hole 311 of the handle 30, so that the plug can be pulled out of the socket easily with less labor.

Further, when the handle 30 is not in use, the user can fold the handle 30, so that the handle 30 can be accommodated in the accommodating space 14 (FIG. 2), thereby saving the space.

Therefore, via the easy-pull type swivel plug of the present invention, the following features and effects can be achieved.

1. The rotatable disk 20 of the present invention is pivoted to the body 10 and is able to drive two conductive pieces 21 to rotate in the range of 360 degrees. Therefore, it is convenient for the user to adjust the degree of rotation according to different conditions and orientations, thereby making the usage of the plug more flexible.

2. The pivoting position between the handle 30 and the body 10 corresponds to the center of the rotatable disk 20. Therefore, the user can concentrate his force on the center of the rotatable disk 20, thereby avoiding the deformation of the conductive pieces 21 caused by a torque generated in misalignment with the center. Further, this feature allows the user to unplug more easily with less labor.

3. The handle 30 of the present invention is provided with a penetrating hole 311. Therefore, the user can put his/her finger into the penetrating hole 311 to facilitate the unplugging operation.

4. When not in use, the handle 30 of the present invention can be accommodated in the accommodating space 14 of the body 10, thereby saving the space.

5. The handle 30 of the present invention is pivoted to the body 10 directly. Therefore, the structure is simpler and the assembling process is easier. As a result, the production cost can be reduced.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An easy-pull type swivel plug, comprising:

a body;

a rotatable disk rotatably provided on one side of the body, the rotatable disk having at least two conductive pieces, the two conductive pieces extending beyond the body; and a handle pivoted to the other side of the body opposite to the rotatable disk in a liftable and foldable manner, the handle including a ring portion converging at a central connecting portion protruding radially therefrom and along its centered axis to be centrally disposed relative to the rotatable disk, a pivoting position of attachment between the central connecting portion and the body corresponding to the center of the rotatable disk.

2. The easy-pull type swivel plug according to claim 1, wherein the body has a body connecting portion corresponding to the center of the rotatable disk, the central connecting portion of the handle pivotally connecting to the body connecting portion.

3. The easy-pull type swivel plug according to claim 2, wherein the body connecting portion has two first pivoting portions, the central connecting portion of the handle has two second pivoting portions, the two first pivoting portions are combined with the two second pivoting portions.

4. The easy-pull type swivel plug according to claim 3, wherein the body connecting portion defines a trough, the two first pivoting portions are disposed on two opposing inner walls of the trough respectively, the central connecting portion defines a protruding block, the two second pivoting portions are disposed on two opposing side walls of the protruding block respectively.

5. The easy-pull type swivel plug according to claim 1, wherein the body has an accommodating space for accommodating the handle.

6. The easy-pull type swivel plug according to claim 1, wherein the handle has a penetrating hole for allowing a finger to be disposed therein.

7. The easy-pull type swivel plug according to claim 1, further comprising a power supply line, wherein the power supply line is connected to one end of the body, one end of the power supply line penetrates into the body and is connected electrically to the two conductive pieces.

* * * * *